US005573192A

United States Patent [19]

Tseng

[11] Patent Number: 5,573,192

[45] Date of Patent: Nov. 12, 1996

[54] THREAD TENSIONING DEVICE FOR A SEWING MACHINE

[76] Inventor: Hsien-Chang Tseng, 9th Floor, No. 13-4, Section 1, Da Ching Street, Taichung, Taiwan

[21] Appl. No.: 515,258

[22] Filed: Aug. 15, 1995

[51] Int. Cl.[6] ..... B65H 59/22

[52] U.S. Cl. ..... 242/150 R; 112/254

[58] Field of Search ..... 242/150 R, 149, 242/150 M; 112/254, 255

[56] References Cited

U.S. PATENT DOCUMENTS

| | | | |
|---|---|---|---|
| 3,347,195 | 10/1967 | Gegauf | 112/254 |
| 3,709,332 | 1/1973 | Rosen | 242/150 M |
| 4,123,984 | 11/1978 | Coulombe | 112/254 |
| 5,042,407 | 8/1991 | Jimenez | 112/254 |
| 5,191,847 | 3/1993 | Kojima et al. | 242/150 R X |

*Primary Examiner*—Michael R. Mansen
*Attorney, Agent, or Firm*—Charles E. Baxley, Esq.

[57] ABSTRACT

A thread tensioning device for a sewing machine includes two plates engaged on a shaft and a spring for biasing the plates toward each other in order to clamp a thread. The plates each includes a thread receiving portion and each includes another portion opposite to the thread receiving portion. A projection is engaged between the opposite portions so as to separate the opposite portions away from each other and so as to form a closely contacted outer peripheral portion in the thread receiving portions, and in order to force the thread toward the shaft.

1 Claim, 2 Drawing Sheets

THREAD TENSIONING DEVICE FOR A SEWING MACHINE

BACKGROUND OF THE INVENTION

1. Field of the Invention

The present invention relates to a tensioning device, and more particularly to a thread tensioning device for a sewing machine.

2. Description of the Prior Art

A typical thread tensioning device for a sewing machine is shown in FIGS. 4 and 5 and comprises two plates 80, 81 engaged on a shaft 82, a spring 83 for biasing the plates 80, 81 toward each other, and a knob 84 threadedly engaged on the shaft 82 for adjusting the resilient force of the spring 83 against the plates 80, 81 in order to adjust the clamping force against the thread 90 which is clamped between the plates 80, 81. However, when the thread 90 is clamped between the plates 80, 81, the plates 80, 81 have a tendency to form an opening outer peripheral portion due to the thickness of the thread 90, such that the thread 90 has a tendency to move radially outward of the plates 80, 81 and to move away from the shaft 82 (FIG. 5) during sewing operations. The thread 90 thus may not be stably retained in place such that the sewing operation will not be stable.

The present invention has arisen to mitigate and/or obviate the afore-described disadvantages of the conventional thread tensioning devices.

SUMMARY OF THE INVENTION

The primary objective of the present invention is to provide a thread tensioning device for a sewing machine in which the thread may be stably retained in place.

In accordance with one aspect of the invention, there is provided a thread tensioning device for a sewing machine, the thread tensioning device comprises a shaft, a pair of plates engaged on the shaft for clamping a thread therebetween, the plates each including a first portion for receiving the thread therebetween and each including a second portion opposite to the first portion, means for biasing the plates toward each other, and spacing means engaged between the second portions of the plates so as to separate the second portions of the plates away from each other and so as to form a closely contacted outer peripheral portion in the first portions, and in order to force the thread toward the shaft.

The spacing means includes a projection means formed in a first of the plates and extended toward a second of the plates so as to separate the plates away from each other.

The thread includes an included angle and includes a bisector, the spacing means is engaged in the bisector.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
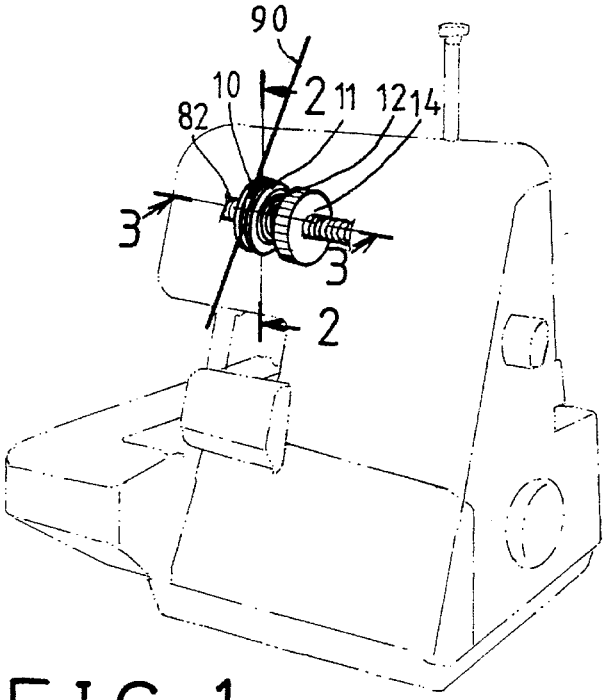
FIG. 1 is a perspective view of a thread tensioning device in accordance with the present invention.
Figure 3:
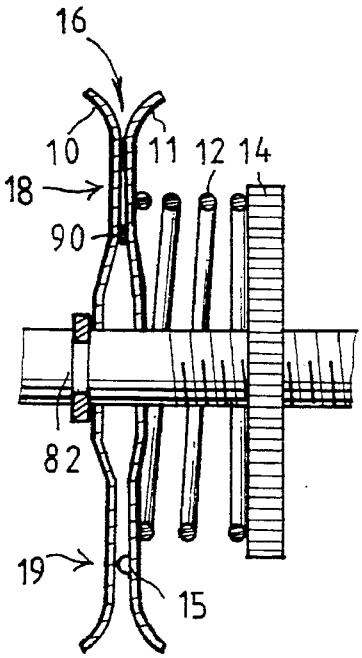
FIG. 3 is a cross sectional view taken along lines 3—3 of FIG. 1.
Figure 2:
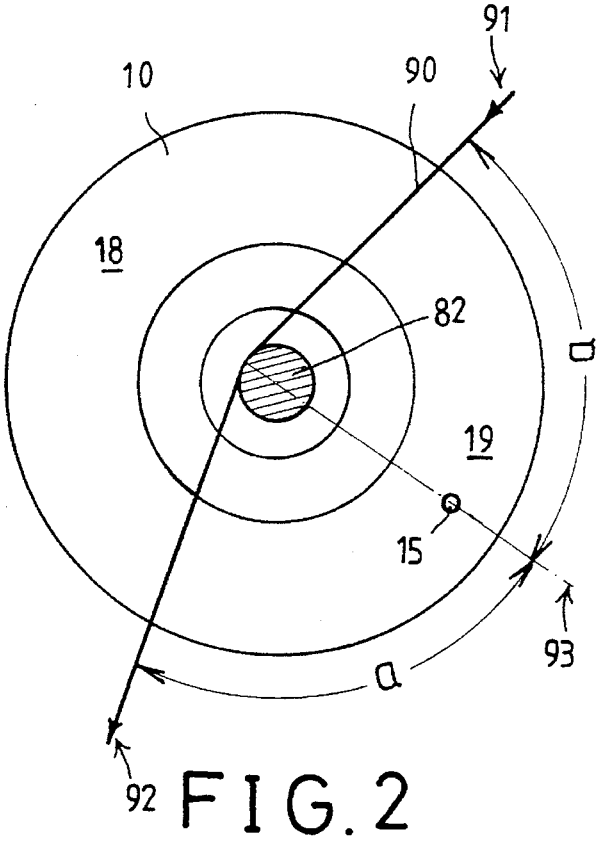
FIG. 2 is a cross sectional view taken along lines 2—2 of FIG. 1.
Figure 5:
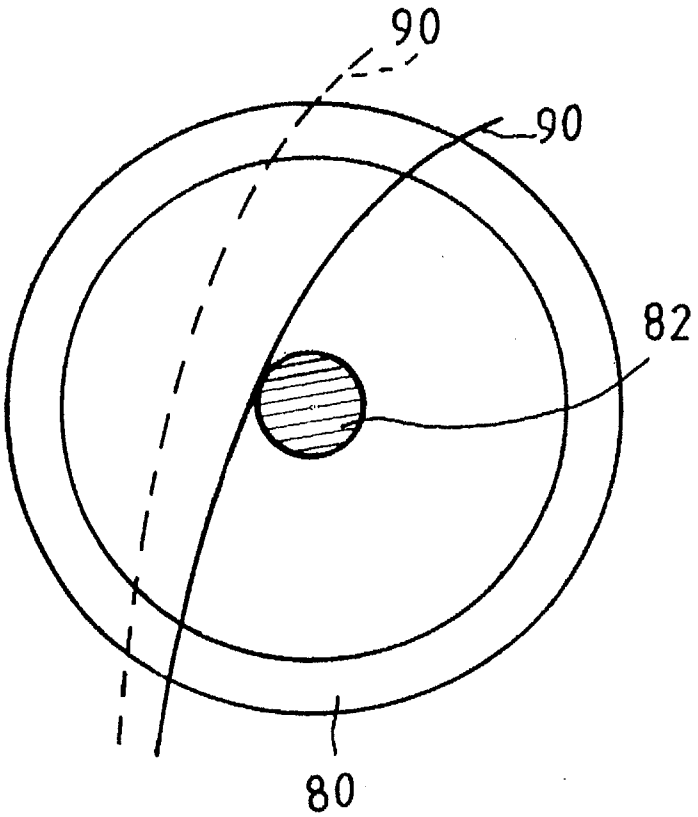
FIG. 5 PRIOR ART
FIG. 5 is a cross sectional view similar to FIG. 2, illustrating the typical thread tensioning device.
Figure 4:
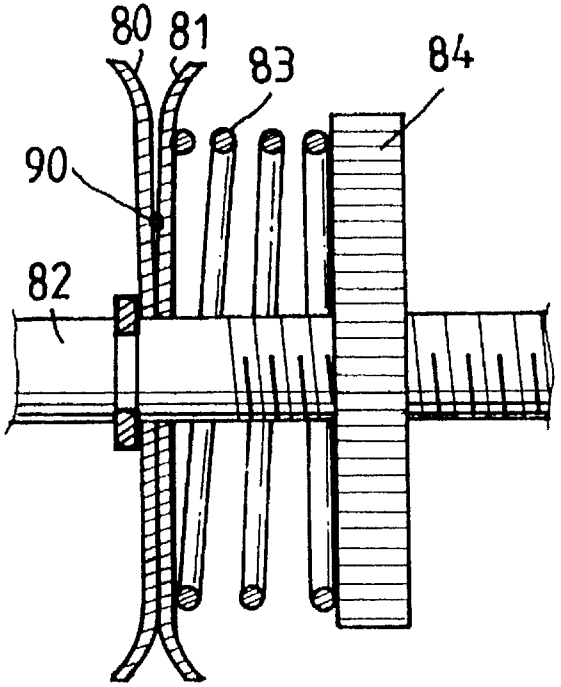
FIG. 4 PRIOR ART
FIG. 4 is a cross sectional view similar to FIG. 3, illustrating the typical thread tensioning device.

Referring to FIGS. 1 to 3, a thread tensioning device in accordance with the present invention comprises two plates 10, 11 engaged on a shaft 82, a spring 12 engaged on the shaft 82 for biasing the plates 10, 11 toward each other, and a knob 14 threadedly engaged on the shaft 12 for adjusting the resilient force of the spring 12 against the plates 10, 11 in order to adjust the clamping force against the thread 90 which is clamped between the plates 10, 11.

As best shown in FIGS. 2 and 3, it is preferable that the thread 90 is tensioned and is in contact with the shaft 82 during sewing operations. The plates 10, 11 each includes a first portion 18 where the thread 90 may be engaged into the plates and may be engaged with the shaft 82; and each includes a second portion 19 located opposite to the thread 90. The present invention further comprises a spacing means 15 provided in the second portions 19 of the plates 10, 11 so as to separate the second portions of the plates 10, 11 away from each other for a small distance, and so as to form a closely contacted outer peripheral portion 16 in the first portions 18, such that the thread 90 may be forced toward the shaft 82.

It is preferable that the spacing means 15 is a projection means 15 formed in one of the plates 10, 11. Certainly, the projection means 15 may also be formed in the other plate. Alternatively, the spacing means 15 may include a plate or an object engaged between the second portions 19 of the plates 10, 11 so as to separate the second portions of the plates away from each other for a small distance.

As best shown in FIG. 3, the thread 90 includes an inward portion 91 and an outward portion 92 and includes an included angle 2*a* formed between the inward and outward portions 90, 91. It is preferable that the projection means 15 is arranged in the bisector 93 of the included angle such that the thread 90 may be suitably forced toward the shaft 82.

Accordingly, the thread tensioning device in accordance with the present invention includes a projection means for separating the second portions of the plates away from each other and for forming a closely contacted outer peripheral portion in the first portions 18, and in order to force the thread 90 toward the shaft 82.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A thread tensioning device for a sewing machine, said thread tensioning device comprising:

a shaft, a pair of plates engaged on said shaft for clamping a thread therebetween, said plates each including a first portion for receiving the thread therebetween and each including a second portion opposite to said first portion, the thread being engaged over said shaft and being bent so as to include a bisector, means for biasing said plates toward each other, and a first of said plates including a projection extended from said second portion thereof and extended toward said second portion of a second of said plates so as to separate said second portions of said plates away from each other and so as to form a closely contacted outer peripheral portion in said first portions, and in order to force the thread toward said shaft, said projection being located in the bisector.

* * * * *